US012458201B2

(12) United States Patent
Almus et al.

(10) Patent No.: US 12,458,201 B2
(45) Date of Patent: Nov. 4, 2025

(54) DISHWASHER WITH AT LEAST ONE AIR OUTLET

(71) Applicant: BSH Hausgeräte GmbH, Munich (DE)

(72) Inventors: Alexander Almus, Bissingen (DE); Thomas Burggraf, Dillingen (DE); Klaus Steinle, Thierhaupten (DE)

(73) Assignee: BSH Hausgeräte GmbH, Munich (DE)

( * ) Notice: Subject to any disclaimer, the term of this patent is extended or adjusted under 35 U.S.C. 154(b) by 234 days.

(21) Appl. No.: 18/021,227

(22) PCT Filed: Sep. 30, 2021

(86) PCT No.: PCT/EP2021/076967
§ 371 (c)(1),
(2) Date: Feb. 14, 2023

(87) PCT Pub. No.: WO2022/069647
PCT Pub. Date: Apr. 7, 2022

(65) Prior Publication Data

US 2023/0292985 A1 Sep. 21, 2023

(30) Foreign Application Priority Data

Sep. 30, 2020 (DE) ..... 10 2020 212 345.4

(51) Int. Cl.
*A47L 15/48* (2006.01)
*A47L 15/42* (2006.01)

(52) U.S. Cl.
CPC ..... *A47L 15/488* (2013.01); *A47L 15/4251* (2013.01); *A47L 15/483* (2013.01);
(Continued)

(58) Field of Classification Search
CPC ..... A47L 15/488; A47L 15/00–508
See application file for complete search history.

(56) References Cited

U.S. PATENT DOCUMENTS 3,807,420 A * 4/1974 Donselman ..... A47L 15/486 34/68
3,876,469 A * 4/1975 Schimke ..... A47L 15/488 34/562

(Continued)

FOREIGN PATENT DOCUMENTS

DE 29601313 U1 6/1996
DE 19604370 A1 6/1997

(Continued)

OTHER PUBLICATIONS

KR20130070278A Machine Translation (Year: 2013).*

(Continued)

*Primary Examiner* — Spencer E. Bell
(74) *Attorney, Agent, or Firm* — Michael E. Tschupp; Andre Pallapies; Brandon G. Braun

(57) ABSTRACT

A dishwasher includes a dishwasher cavity for treatment of items to be washed and an air outlet for blowing out air from a dishwasher cavity. The air outlet is arranged in a lower quarter of a height of the dishwasher and extends as a slotted outlet across at least two thirds of a width of the dishwasher. The air outlet includes a first air-guiding element designed for a targeted removal of air into a region in front of a front face of the dishwasher, with the first air-guiding element applying a downward component to outflowing air.

15 Claims, 4 Drawing Sheets

(52) U.S. Cl.
CPC ..... *A47L 15/486* (2013.01); *A47L 2401/19* (2013.01); *A47L 2501/12* (2013.01)

(56) References Cited

U.S. PATENT DOCUMENTS

| | | | | |
|---|---|---|---|---|
| 4,179,821 | A | 12/1979 | Herbst | |
| 5,681,746 | A | 10/1997 | Bodner et al. | |
| 8,313,583 | B2 | 11/2012 | May | |
| 9,888,829 | B1 | 2/2018 | Bongivengo | |
| 10,024,561 | B2 | 7/2018 | Olson | |
| 2010/0043250 | A1 | 2/2010 | Berends | |
| 2010/0083991 | A1 | 4/2010 | Tolf | |
| 2011/0126864 | A1 | 6/2011 | Kim | |
| 2011/0241503 | A1 | 10/2011 | Simon | |
| 2013/0206186 | A1 | 8/2013 | Tang | |
| 2014/0170954 | A1* | 6/2014 | Hintz | A47L 15/48 454/251 |
| 2014/0238450 | A1 | 8/2014 | Bertram | |
| 2014/0360534 | A1 | 12/2014 | Olson | |
| 2016/0022116 | A1 | 1/2016 | Delellis | |
| 2017/0290489 | A1 | 10/2017 | Noriega | |
| 2018/0125329 | A1 | 5/2018 | Parmeggiani | |
| 2021/0100424 | A1 | 4/2021 | Tan | |

FOREIGN PATENT DOCUMENTS

| | | | | |
|---|---|---|---|---|
| DE | 19704430 | U | 8/1998 | |
| EP | 0378836 | A1 | 7/1990 | |
| EP | 0521815 | A1 | 1/1993 | |
| EP | 2682038 | A2 | 1/2014 | |
| EP | 3020319 | A1 | 5/2016 | |
| EP | 3213666 | A1 | 9/2017 | |
| JP | 2018140243 | A | 9/2018 | |
| KR | 20130070278 | A1 | 6/2013 | |
| KR | 101308832 | B1 | 9/2013 | |
| KR | 101685357 | B1 | 12/2016 | |
| WO | 2013042036 | A1 | 3/2013 | |
| WO | 2013090155 | A1 | 6/2013 | |
| WO | WO-2015107474 | A1 * | 7/2015 | A47L 15/486 |

OTHER PUBLICATIONS

International Search Report PCT/EP2021/076967 dated Jan. 12, 2022.
National Search Report, DE 102020212345.4, Jul. 12, 2021.
National Search Report, CN 2021800670181, dated Mar. 13, 2025.

* cited by examiner

DISHWASHER WITH AT LEAST ONE AIR OUTLET

CROSS-REFERENCES TO RELATED APPLICATIONS

This application is the U.S. National Stage of International Application No. PCT/EP2021/076967, filed Sep. 30, 2021, which designated the United States and has been published as International Publication No. WO 2022/069647 A1 and which claims the priority of German Patent Application, Serial No. 10 2020 212 345.4, filed Sep. 30, 2020, pursuant to 35 U.S.C. 119(a)-(d).

The contents of International Application No. PCT/EP2021/076967 and German Patent Application, Serial No. 10 2020 212 345.4 are incorporated herein by reference in their entireties as if fully set forth herein.

BACKGROUND OF THE INVENTION

The present invention relates to a dishwasher having at least one air outlet for blowing out in particular humid air from a dishwasher cavity in which dishware, glasses, cutlery and similar items to be washed can be treated.

In such dishwashers it is desirable to be able to remove the items to be washed from the dishwasher cavity, with the items to be washed being dried as completely as possible and without water stains.

For an effective drying result of dishware, glasses, cutlery and similar items which can be treated in a dishwasher cavity, it is advantageous to be able to remove humid air from the dishwasher cavity for effective drying. It is thus known to connect the dishwasher cavity to an air outlet which transports humid air from the dishwasher cavity into the external surroundings. Thus an air outlet is frequently located in the upper region of a front door which can be opened and closed. Supplying air into this moving unit is thus relatively complex and expensive, and due to the arrangement at the top of the appliance there is the risk that cabinets or countertops located above the dishwasher or even parts of the dishwasher and the housings thereof are damaged by the high level of escaping moisture or that the kitchen floor becomes wet and thus slippery in the region in front of the dishwasher. Additionally, significant air drafts can occur in the vicinity of such an air outlet, which is very uncomfortable particularly in small kitchens where the users sit in the vicinity of a dishwasher.

The problem underlying the invention is to avoid to the greatest possible extent water vapor acting on the surrounding items of furniture, the kitchen floor and front parts of the dishwasher, together with an attractive visual arrangement.

BRIEF SUMMARY OF THE INVENTION

The invention solves this problem by a dishwasher having the features of the invention.

If spatial and/or location information is provided within the context of the invention, this is preferably to be understood to mean from a standpoint which a user adopts in front of the household dishwasher according to the invention when using and/or operating the dishwasher as intended, when this household dishwasher is positioned or installed ready for operation.

Since according to the invention at least one air outlet is arranged in the lower quarter of the appliance height, if any water vapor rises from the air outlet it initially acts on the dishwasher itself so that a portion of the water can condense there and not reach the items of furniture located thereabove. Additionally, since the air outlet extends as a slotted outlet across at least two thirds of the width of the dishwasher, a wide distribution of the escaping moisture and a thorough mixing with the drier external air in the room is achieved. The escaping humid air is distributed such that a significant input of moisture at certain points into items of furniture is avoided. The air drafts are also considerably reduced by the effective distribution width of the air. Since the air outlet has at least one air-guiding element for the targeted removal of air into the region in front of the front face of the dishwasher, the air-guiding element applying a downward component to the outflowing air, the warm air can rise into a region at a distance in front of the kitchen furniture fronts, so that these fronts remain protected from moisture acting thereon. Due to the downwardly blown-out component, in the region of the furniture panel, in particular also in the region of a front door of the dishwasher itself, the escaping air can be initially diverted from the front of the item of furniture, in particular from the front surface of the front door of the dishwasher which is preferably provided with a decorative panel or furniture panel, and preferably also from the front lower edge of the front door and/or the prefixed decorative or furniture panel, and only rise by a few centimeters further outside the items of furniture due to the intrinsic heat.

An air-guiding element is very advantageously formed by a wall which is otherwise present and which upwardly defines the air outlet. Additional components are thus avoided, which simplifies the construction and reduces the material cost.

If the air outlet is arranged on the front face of the dishwasher facing a user and blows out the air with a forward component, it is ensured that the blown-out humid air cannot collect inside a row of kitchen units but passes to the front into the atmosphere in order to permit at that point an effective distribution of the moisture contained therein.

If advantageously the air-guiding element faces downwardly by at least two degrees toward the front face relative to the horizontal, the blown-out humid air can be conducted, for example, below a door leaf which protrudes downwardly into the plinth region, in particular the plinth recess space, of the dishwasher and which is formed, in particular, by a furniture panel or decorative panel positioned on the front door on the front face, so that this door leaf remains free of moisture, in particular on its lower edge.

In particular, the air-guiding element can face downwardly by at least four degrees toward the front face, and thus initially can bring about a significant downward movement of the escaping airflow, before it rises at a distance in front of the items of furniture due to its heat. At the same time, however, the downward movement remains sufficiently small that the escaping air does not leave behind any damp stains on the floor which could constitute a slipping hazard. In particular, therefore, the angular deviation of the air-guiding element and thus of the blown-out airflow toward the horizontal remains less than ten degrees, if the air outlet is arranged in the upper region of a plinth of a dishwasher standing on the floor.

For externally limiting the airflow, a wall which downwardly defines the air outlet can form a second air-guiding element and with the first air-guiding element can form a blow-out channel of several centimeters in length facing in the direction of the front face. Then a defined airflow which is substantially laminar is possible. The second air-guiding element can be located horizontally or rise slightly, in order to achieve a nozzle effect by the tapering of the blow-out channel. The possible gradient of the second air-guiding element, however, is less than the slope of the upper air-guiding element in order to maintain the downward component in any case.

It is advantageous in terms of manufacturing technology if the blow-out channel is defined as a whole by a plastics molded part. This part can be in one piece, for example.

Moreover, the blow-out channel can have a plurality of guide ribs extending in the direction of flow toward the front face for the outflowing air, in order to achieve in this manner a diffusor effect with a uniform outflow of the air.

A channel which extends over the width of the air outlet and which is upwardly open is very advantageously located on the rear face of the air outlet as an airflow equalizer, sub-flows of air being able to be guided therein and then passing uniformly through the entire channel. A front edge of the upwardly protruding channel can adjoin at an angle the substantially horizontally extended air outlet which is arranged downstream thereof, and which thus receives the widely distributed air from the channel and guides this air out to the front.

The sub-flows in the aforementioned channel are particularly advantageously separated from a common airflow coming from the dishwasher cavity via an air distributor. Thus only one supply line is required and the separation of the air takes place only when the air enters the channel.

Preferably, the blow-out structural unit comprises an air channel which in its final mounting position, in particular, protrudes upwardly and extends in the width direction, the blow-out channel of the, in particular slotted, air outlet extending to the front face and adjoining the upper end thereof, and the air channel has, in particular, a rear connection for an air supply line. Thus in the final mounting position of the blow-out structural unit, when viewed in the vertical direction, the air channel is located lower, i.e. below the, in particular slotted, blow-out channel which extends or protrudes to the front. In the final mounting position of the blow-out structural unit, in particular, the air channel is advantageously arranged behind the front plinth panel of the dishwasher. In particular, the air channel is mounted on the rear wall thereof in a releasable manner. Preferably, the hollow space of the air channel is closed at its lower end in an air-tight and/or water-tight manner, so that in its lower region it forms a condensate collecting tank. Expediently, the air distributor starts in the preferably rear connection of the blow-out structural unit and extends over the preferably rear air inlet connected thereto, into the, in particular, upwardly protruding air channel, expediently as far as the front wall thereof. As a result, the dishwasher-interior airflow supplied to the connection can be branched into two sub-flows, in particular a left-hand sub-flow and a right-hand sub-flow.

If the air outlet is at least 40 centimeters wide overall (in particular relative to a household dishwasher having an appliance width of 60 cm) it is possible to achieve a very wide and uniform distribution of the moisture and the escaping air. Particularly advantageously, the width of the air outlet can take up approximately the entire appliance width.

In particular, the air outlet is configured as a flat slotted outlet with a height-to-width ratio of less than 1:20, in particular of between 1:20 and 1:200, preferably of approximately 1:100 (in particular relative to a household dishwasher having an appliance width of 60 cm). In spite of the very low height, structurally and visually, a large discharge surface can be achieved thereby.

It is very advantageous if the air outlet is arranged on the front face of the dishwasher facing a user and blows out the air with a forward component. The blown-out airflow, which due to its wide distribution generates few air drafts, is thus conducted away from the items of kitchen furniture and the collection of moisture in the installation space of the items of kitchen furniture is then avoided. Thus the air which escapes there and which is frequently laden with moisture can be rapidly mixed with the drier external air in the kitchen and over a large area.

If the air outlet overlaps a panel (plinth panel) which terminates a plinth to the front and protrudes by at least the same distance relative thereto toward the front face, the humid air can escape sufficiently far to the front that it does not apply too much moisture either to the kitchen floor or the front face of the dishwasher, in particular a door. At first, the blown-out airflow can flow out at an initial speed in a slightly downward direction and, due to its high temperature, can be provided with a rising component upwardly at a distance in front of the dishwasher.

A high degree of efficiency can be achieved when the air outlet can be activated by at least one conveying member, such as a fan wheel, which is arranged in the lower region of the dishwasher behind the air outlet in the depth direction. The fan wheel or the like can be located approximately at the same height as the air outlet itself and arranged in a space-saving manner in the plinth of the dishwasher.

An advantageous development of the invention provides that the fan wheel or a similar conveying member can be activated in a clocked manner or even continuously, and namely during the drying phase of the respective dishwashing program and/or even beyond the end of this drying phase over a time period of several days. In the last case, the household dishwasher can advantageously serve as an item of storage furniture or a store for items to be washed, such as for example dishware, glasses, cutlery and the like, and can subsequently dry over several days repeatedly in phases or even continuously these items to be washed which were previously washed and dried during the dishwashing program respectively carried out. The front door of the household dishwasher preferably remains closed in each case, both during the regular drying phase of the dishwashing program respectively to be carried out and during a potentially chronologically following "storage function phase". This storage of the items to be washed in the dishwasher interior of the dishwasher cavity, preferably with the front door remaining closed, chronologically following the end of the drying phase of the dishwashing program respectively previously carried out, is denoted as the "storage function phase". The conveying member can be activated both for the operation thereof during the drying phase of the respective dishwashing program and during the potentially chronologically following "storage function phase", if required, by detecting moisture in the dishwasher interior of the dishwasher cavity.

Further advantages and features are found in the exemplary embodiments of the subject matter of the invention shown in the drawing and described hereinafter.

DETAILED DESCRIPTION OF EXEMPLARY EMBODIMENTS OF THE PRESENT INVENTION

Figure 1:
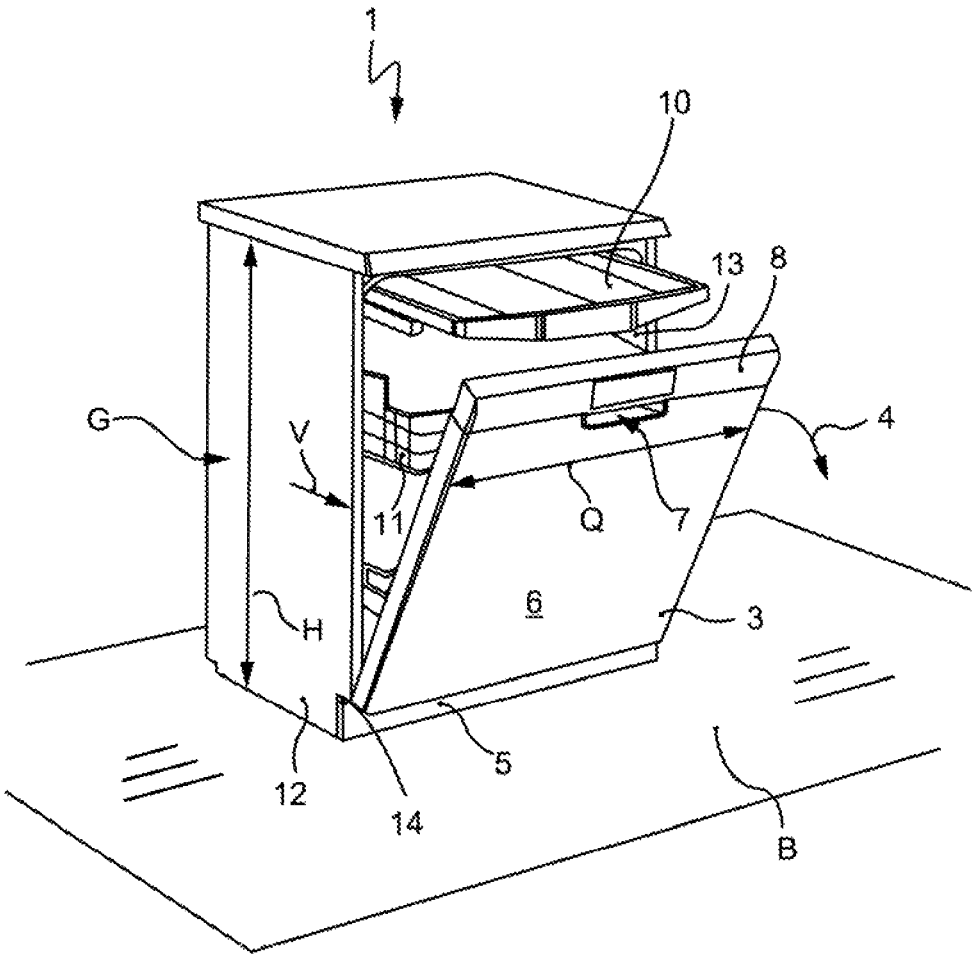
FIG. 1 shows a schematic perspective view obliquely from the front of an advantageous embodiment of a dishwasher, in particular a household dishwasher, preferably with a recessed plinth in the lower region, wherein a blow-out structural unit with an air outlet is arranged in the plinth recess space.

The household appliance 1 shown schematically in FIG. 1 is a dishwasher 1 and namely a household dishwasher in this case. Other household appliances 1 with a drying function for the items to treated can also be considered in principle for a configuration according to the invention.

The household dishwasher 1, which is described hereinafter according to FIG. 1, has a dishwasher cavity 2 for receiving items to be washed and to be treated, such as dishware, pots, cutlery, glasses, cooking utensils, and the like, as a constituent part of an appliance body G which is partially open or closed outwardly. The items to be washed can be held, for example, in dishware baskets 11 and/or a cutlery drawer 10 and so-called washing liquor can be applied thereto. "Washing liquor" is understood to mean in this case fresh water or, in particular, water circulating during operation with or without detergent and/or rinse aid and/or drying agent. In particular, the washing liquor has an ion exchanger for softening. The washing liquor can additionally be subjected to a greater or lesser extent to contamination from the ongoing operation. The dishwasher cavity 2 can have an at least substantially rectangular footprint with a front face V facing a user in the operating position. This front face V can form at the same time a part of a kitchen front consisting of items of kitchen furniture standing adjacent to one another or in a stand-alone appliance can be unrelated to other items of furniture.

The dishwasher interior of the dishwasher cavity 2, in particular, can be closed on this front face V by a front door or flap 3. This front door 3 is shown in FIG. 1 in the partially open position and thus obliquely to the vertical. In its closed position, however, the door stands upright and, according to the drawing, for the opening thereof is able to be pivoted open toward the front about a lower horizontal axis and downwardly in the direction of the arrow 4 so that it is located at least approximately horizontally in the fully open position.

On the vertical outer face and front face V of the dishwasher 1 facing the user, in the closed position, the front door 3 can be provided with a decorative panel or furniture panel 6 in order to achieve thereby a visual and/or haptic enhancement and/or an adaptation to the surrounding items of kitchen furniture.

The dishwasher is configured here as a stand-alone appliance or as a so-called partially integrated or even fully integrated appliance. In the last-mentioned case the appliance body G can also be substantially terminated by the external walls of the dishwasher cavity 2. A housing outwardly surrounding the dishwasher cavity can then be dispensed with. A plinth 12 can be located in the lower region of the dishwasher for receiving, in particular, functional elements, such as for example a pump for circulating the washing liquor and an air outlet 14 which is described in more detail below.

In the exemplary embodiment according to the drawing, the movable door 3 is assigned in its upper region a control panel 8 which extends in the transverse direction Q of the dishwasher and which can comprise an access opening 7 which is accessible from the front face V for manually opening and/or closing the door 3. In the transverse direction Q the dishwasher frequently has an extent of 45, 50 or 60 centimeters. In the depth direction T from the front face V to the rear, the extent is also frequently approximately 60 centimeters. The values are not mandatory. Moreover, the dishwasher 1 does not have to stand directly on a floor B, but can also be installed approximately at eye level within an item of kitchen furniture, so that the problem mentioned in the introduction of an air draft through an air outlet 14, in particular, has to be taken into account.

The dishwasher cavity 2 is defined over the periphery, when the door or flap 3 is closed, by a total of three fixed vertical walls 13 and two horizontal walls 13, one thereof forming a ceiling (above) and another forming a bottom (below) of the dishwasher cavity 2. A left-hand upright side wall 13 to the left, and a right-hand upright side wall 13 to the right, adjoin the front face V facing the user in the transverse direction Q.

The wall 13 forming the bottom of the dishwasher cavity 2 and defining this dishwasher cavity substantially downwardly is located approximately horizontally above the plinth 12, i.e. parallel to an external floor B on which the household dishwasher 1 can stand. A higher installation, for example approximately level with a countertop, is also possible as discussed, in particular within a cabinet. The lower edge of the dishwasher 1 is then located in the installed position ca. 70 to 110 centimeters above the floor.

The dishwasher 1 is provided with at least one air outlet 14 for blowing out in particular humid air from the dishwasher cavity 2. This air outlet 14 can blow out air, in particular humid air, from the dishwasher interior of the dishwasher cavity into the free air space on the front face V of the dishwasher 1 facing a user, so that the humid air is not drawn inside a row of kitchen units and is not able to cause damage there due to the moisture. The blowing out of in particular humid dishwasher-interior air via the air outlet 14 preferably takes place during the program-terminating drying phase of a dishwashing program to be carried out and/or during at least one additional drying phase of a chronologically following "storage function phase". In any case, the front door 3 remains closed.

Figure 2:
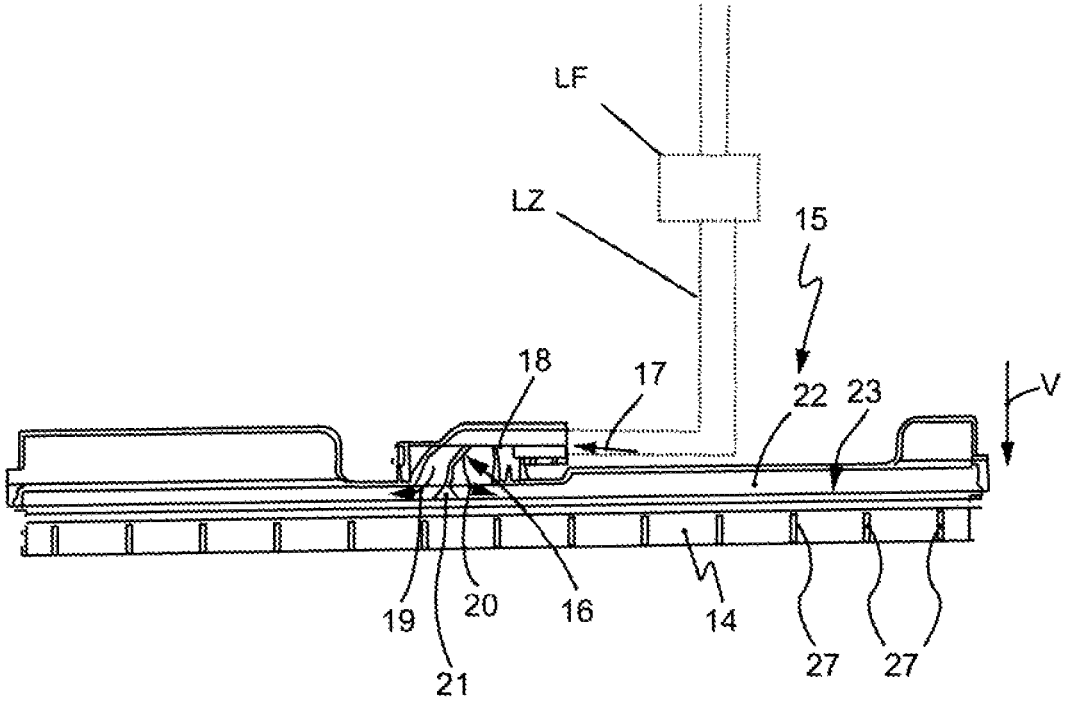
FIG. 2 shows a view from above of the blow-out structural unit of the dishwasher of FIG. 1 comprising an air outlet, wherein the blow-out structural unit has on the rear face of the air outlet an air distributor and an (air distributor) channel for guiding the sub-flows formed by the air distributor.

The air outlet 14 is a constituent part of a blow-out structural unit 15 which is shown by way of example in FIG. 2 as a whole. The blow-out structural unit 15, comprising the at least one air outlet 14, extends over at least half of the width Q of the dishwasher 1, in particular even more. Thus a particularly uniform distribution of the escaping air can be achieved, so that the occurrence of air drafts is minimized.

The blow-out structural unit 15 can be formed as a whole from plastics. Moreover, the air outlet 14 can be separated into a plurality of partial slots which are aligned adjacent to one another. These slots do not all have to be of equal length. It is important that an air outlet 14 which extends over the width and which permits a high throughflow of air is provided as a whole, in order to achieve in this manner a wide distribution of the moisture contained in the air.

Figure 3:
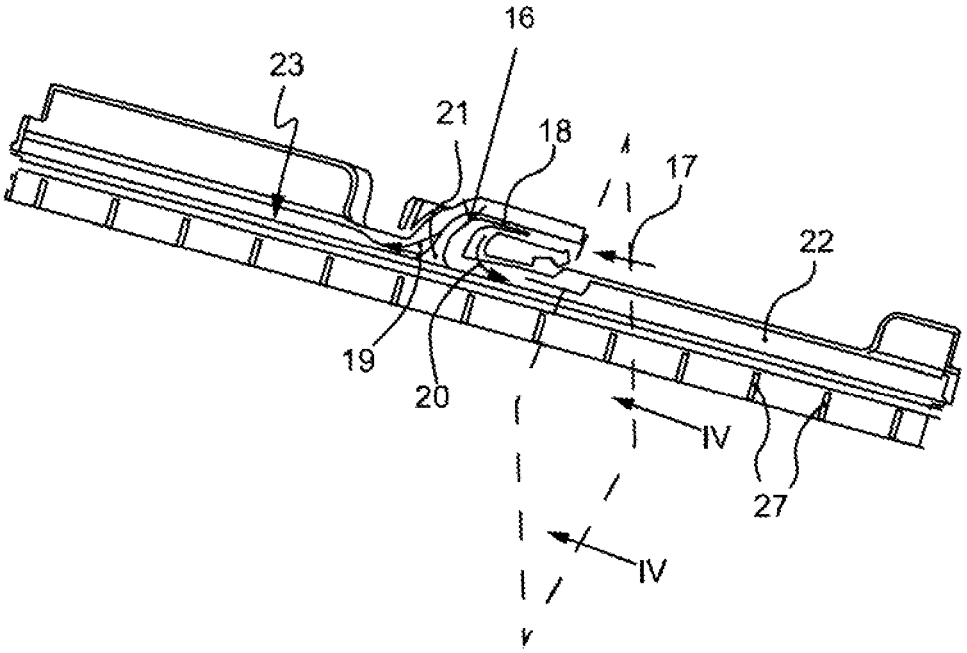
FIG. 3 shows a perspective view obliquely from above of the blow-out structural unit according to FIG. 2.
Figure 4:
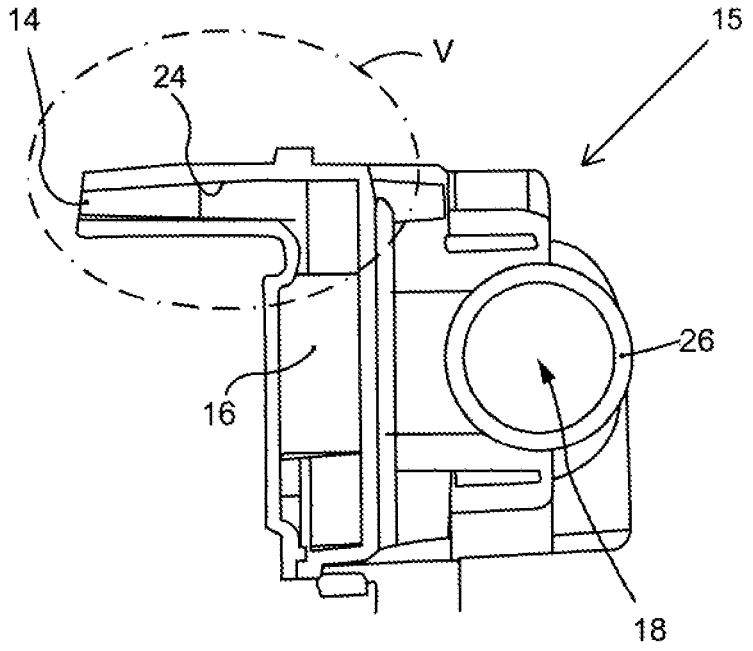
FIG. 4 shows a partial sectional view of the blow-out structural unit approximately corresponding to a view in the cutting plane IV-IV in FIG. 3.

The air outlet 14 is arranged here in the lower quarter of the appliance height and extends as a one-piece or multi-piece slotted outlet over at least two thirds of the width Q of the dishwasher 1. In particular, the air outlet 14 is at least 40 centimeters wide. The air outlet, as can be clearly identified in FIGS. 2 and 3, can also extend over approximately the entire width Q of the dishwasher 1. At least one connection 26, which is located on the rear face of the air outlet 14, is provided for introducing humid air from the dishwasher cavity 2 into the air outlet 14. Preferably, an air supply line which is designed with an excess length, in particular a flexible connecting hose or a corrugated pipe, is attached to the rear connection 26 of the blow-out structural unit 15 from the plinth 12, said air supply line supplying air from the dishwasher interior of the dishwasher cavity to the connection 26. In FIG. 2 the air supply line LZ is indicated by dotted lines.

For suctioning the dishwasher-interior air from the dishwasher interior of the dishwasher cavity and blowing out this dishwasher-interior air via the blow-out structural unit 15, at least one conveying member such as for example a fan can be provided in or in front of the connection 26 thereof, said fan also being able to be activated continuously and/or in a clocked manner, even over a period of several days. In FIG. 2, an air conveying member LF, such as for example a fan, is incorporated in the air supply line LZ. In FIG. 2 the fan is only shown schematically as a dotted rectangle. The air supply line is connected with its end on the upstream side to an air outlet opening which is provided in one of the defining walls of the dishwasher interior, in particular in a wall, preferably a side wall, of the dishwasher cavity.

The air introduced through this connection 26 can be initially supplied to an air distributor 16 which protrudes into the cross section of the connection 26, which in this case is tubular, and separates the airflow 17 approximately centrally. In particular, the start of the air distributor 16 forms a narrow upright rib 18, sub-flows 19, 20 being formed to the left and right thereof.

The rib 18 transitions into a curved air-guiding element 21 which protrudes with its end facing away from the rib 18 into a channel 22 which is arranged behind the air outlet 14 (i.e. facing away from the front face V). The channel 22 has a significantly greater height relative to the air outlet 14 and can have on its lower face drains for condensed water—not illustrated here. The air-guiding element 21 widens in the channel 22, in a view from above, similar to a triangle with rounded sides and extends to a front channel wall 23. As a result, it is ensured that the sub-flows 19, 20 which are formed in the channel 22 do not mix again.

Rather, the sub-flows 19, 20 in the channel 22 diametrically oppose one another and run from the ideally central air distributor 16 relative to the transverse direction Q approximately to the two outer walls of the dishwasher 1. The sub-flows 19, 20 have a sufficiently high speed in order to maintain approximately a uniform density on their opposing paths through the channel 22, before the air can escape therefrom with an upward and forward component, as is described hereinafter:

The above-mentioned channel 22 extends parallel to the air outlet 14 in the width direction Q of the dishwasher 1. In this case, relative to the vertical height H of the dishwasher 1, the air distributor 16 is at least partially held in a plane below the air outlet 14, as is the channel 22 in which air is introduced by the air distributor 16. The air from the air distributor 16 thus does not escape directly through the air outlet 14 but passes first with its sub-flows 19, 20 through the channel 22 in both directions. By the further introduction of air, the air is continually pushed out upwardly in the upwardly open channel 22 and due to the upper baffle 24 then only has the opportunity to flow to the side into the air outlet 14.

This is possible since the channel 22 is open upwardly and an upright front channel wall 23 adjoins the horizontally extended air outlet 14 at an angle, the air outlet ideally having the same extent in the width direction Q as the channel 22, in particular at least 40 centimeters.

In particular, to this end the—one-piece or multi-piece—air outlet 14 according to FIG. 2 is configured as a flat slotted outlet, the height-to-width ratio thereof being able to be less than 1:20, in particular even less than 1:20. Thus with a 40 centimeter wide air outlet 4 (in particular relative to a household dishwasher having an appliance width of 60 cm), the height thereof in the vertical direction H is less than ca. 2 centimeters. Thus it is ensured that, on the one hand, the air outlet takes up less installation space in the vertical direction H and, on the other hand, the overall extent of the air outlet 14 is sufficiently large in order to remove a high volume of air and thus to keep the air drafts to a minimum.

The air outlet 14 has at least one air-guiding element 24 for the targeted removal of air into the region in front of the front face V of the dishwasher 1, a downward component being applied to the outflowing air (28). In this case, the air-guiding element 24 extends in one piece over the entire width of the air outlet 14, which is not mandatory. Additionally the air-guiding element is formed by a wall upwardly defining the air outlet 14 and thus does not require a separate structural element which improves the manufacturing and the durability. A high degree of stability is achieved.

Figure 6:
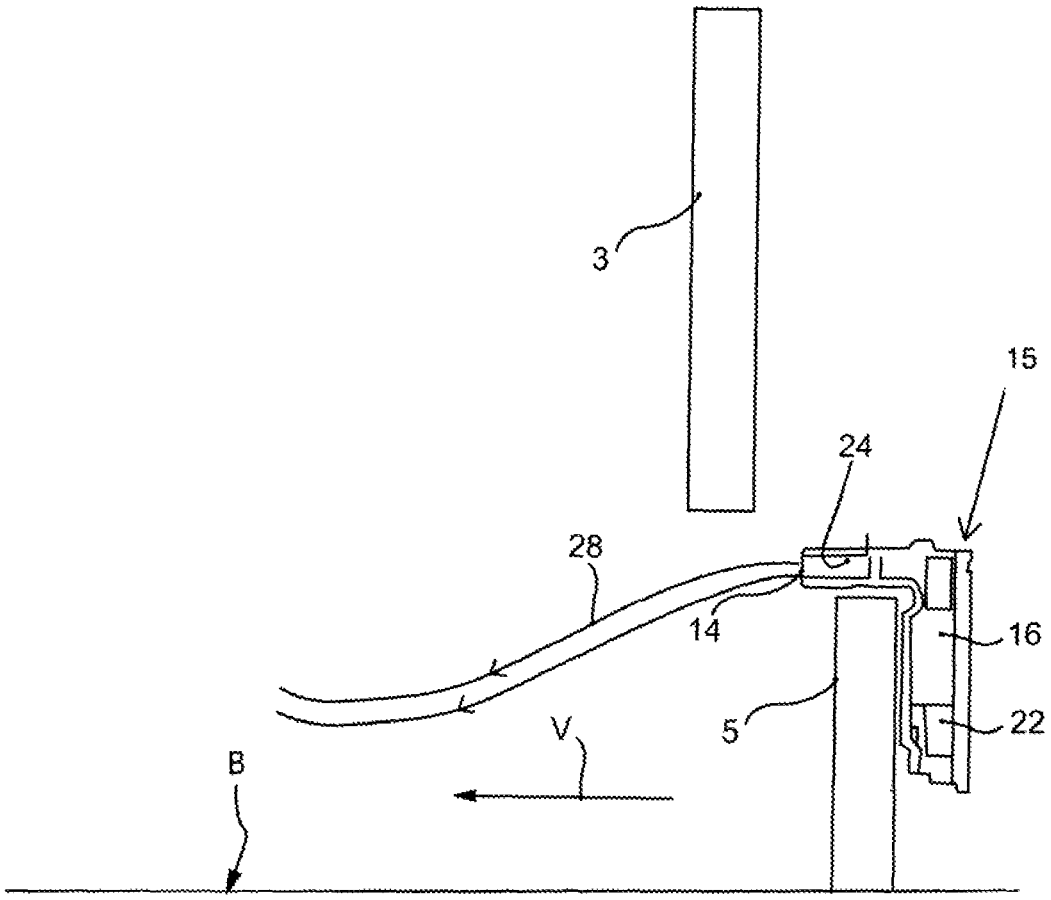
FIG. 6 shows a schematic side view of the front region of the dishwasher with the installed position of the air outlet and the resulting airflow which is blown out to the front.

As can be identified in FIG. 6, for example, the air outlet 14 is arranged on the front face V of the dishwasher 1 facing a user and blows out the air 28 with a forward component V.

The air-guiding element 24 faces downwardly by at least two degrees toward the front face V. The slope can also be greater and face downwardly by at least four degrees.

Figure 5:
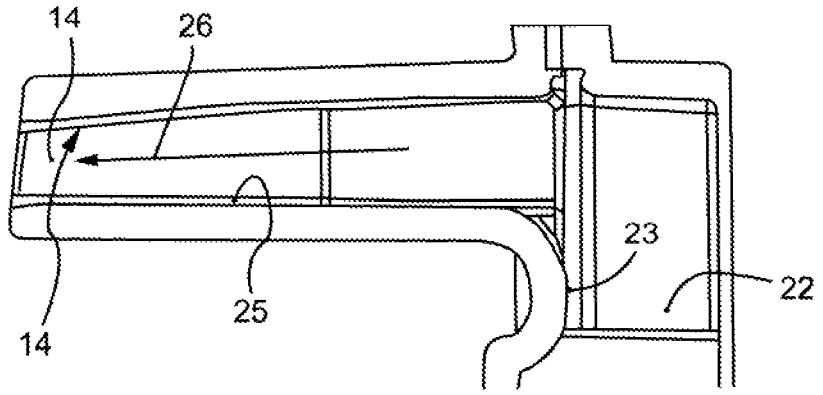
FIG. 5 shows a detailed view approximately corresponding to the detail V in FIG. 4.

A downwardly defining wall 25 is provided opposite the air-guiding element 24 on the air outlet 14, said defining wall forming a second air-guiding element and in this manner forming with the first air-guiding element 24 a blow-out channel 26 of several centimeters (typically approximately 5 to 8 centimeters) facing in the direction of the front face V, as can be identified clearly in FIG. 5, for example.

The blow-out channel 26 can be defined as a whole by a frame-like plastics molded part, but other materials are also possible in principle. If, for example, an injection-molded part is provided, on the lower face the blow-out channel 26 can be provided with a plurality of guide ribs 27 extending in the direction of flow toward the front face V, for the outflowing air 28. This leads to a diffusor effect, with substantially laminar air components flowing out toward the front face V in the blown-out humid, warm airflow 28.

As can be clearly identified in FIG. 6, for example, by means of the advantages according to the invention, the air outlet 14 with the blow-out channel 26 extending to the front V can also overlap a panel 5 which is clearly recessed relative to a door 3 and which terminates a plinth 12 at the front, and protrudes by at least the same distance relative thereto toward the front face V. As a result, no moisture acts on the panel 5 itself. By the downward component introduced via the air-guiding element 24 in the blown-out airflow 28, however, this airflow is also conducted below the door 3 which protrudes further toward the front face V (for example 5 to 10 centimeters), without for example wetting the front decorative element 6 at that point. Rather, the airflow 28 is conveyed a few centimeters further toward the front V before it can rise due to the higher intrinsic heat relative to the ambient kitchen air. This is because it is nevertheless sufficiently far removed from the furniture fronts. At the same time, due to the air-guiding element 24 having only a slight slope, wetting of the floor B is also avoided. The wide extent of the air outlet 14 additionally prevents an irritating air draft.

Advantageously, in particular, a dishwasher with the following advantageously configured blow-out structural unit 15 for mounting on a plinth panel 5, in particular a floor-plinth panel, can be advantageous:

In particular, the air distributor 16 of the blow-out structural unit 15 is assigned to the inlet-side connection 26 and/or is arranged downstream thereof in the direction of flow. The air distributor is arranged upstream of the slotted blow-out channel of the air outlet 14. This air distributor 16 preferably separates the dishwasher-interior airflow, which is supplied to the connection 26, into a left-hand sub-flow and a right-hand sub-flow. In this case, the left-hand sub-flow is fed into the left-hand portion and the right-hand sub-flow is fed into a right-hand sub-portion of the upwardly protruding air channel 22. This air channel 22, when viewed in the direction of flow, is arranged upstream of the slotted blow-out channel of the air outlet 14. The air channel is preferably located lower than the air outlet, when viewed in the vertical direction. The air channel preferably extends substantially over the same width extent as the blow-out channel. In particular, the upper end thereof is connected to the inlet of the blow-out channel extending to the front over the entire width thereof (when viewed from the front). The air inlet with the connection 26 is preferably provided approximately in the center of the width extent of the air channel 22 in the rear wall thereof. The upwardly protruding air channel 22 can thus advantageously function as a condensation region. Preferably, the hollow space of the air channel 22 is closed at its lower end in an air-tight and/or water-tight manner, so that in its lower region it forms a condensate collecting tank. In this manner, when viewed from the front, the air distributor 16 ensures that a left-hand sub-flow of the dishwasher-interior airflow, which is supplied to the inlet-side connection 26, acts on the left-hand half of the upwardly protruding air channel 22 upstream of the air outlet 14 and the adjoining left-hand half of the blow-out channel of the air outlet 14, which extends to the front and in the width direction or transverse direction, and a right-hand sub-flow of the dishwasher-interior airflow, which is supplied to the inlet-side connection 26, acts on the right-hand half of the upwardly protruding air channel and the adjoining right-hand half of the blow-out channel of the air outlet 14, which extends to the front, when the air inlet is provided with the connection for the air supply line, in particular approximately centrally, on the rear face of the upwardly protruding air channel, when viewed in the transverse direction.

Preferably, the inlet-side connection, the air distributor 16, the upwardly protruding air channel 22 and the slotted blow-out channel of the air outlet 14 are constituent parts of the blow-out structural unit 15. This unit can be configured, in particular, integrally or in one piece. Preferably, this unit can be manufactured from plastics.

The blow-out structural unit 15 thus configured is able to be advantageously mounted on a front panel 5, in particular a floor-plinth panel—for example as shown schematically in FIG. 6 in side view—which preferably terminates a potentially present plinth recess space of the dishwasher, except for an upper gap remaining free between the lower edge of the front door 3, which is potentially provided with a decorative panel or furniture panel, and the upper edge of the panel 5. Expediently, the upwardly protruding air channel 22 thereof (when viewed from the front in the depth direction) is arranged behind the rear face of the front panel 5, in particular the plinth panel, while the slotted blow-out channel of its air outlet 14 protrudes over the upper edge of the front panel 5, in particular the plinth panel, in particular bears thereagainst. The air channel 22 is thus concealed by the front panel 5, in particular the plinth panel, i.e. it is not visible from the front. Due to the slotted shape of the blow-out channel, it is barely visible from the front on the upper edge of the front panel, in particular the floor-plinth panel. In particular, the air channel 22—as in the exemplary embodiment of FIG. 6—can be mounted on the rear face of the front panel 5, in particular the plinth panel—preferably in a releasable manner. In the case of a floor-plinth panel—as shown in FIG. 6—this stands on the floor B.

A dishwasher 1 which is configured according to the principle according to the invention is not only able to carry out the program-terminating drying phase of a dishwashing program respectively to be carried out, but if required can also be easily provided with a so-called "storage function" which makes it possible for the items to be washed to remain in the dishwasher cavity 2 after the treatment without becoming wet again. The items to be washed can remain in the dishwasher cavity for several days without impairing the dryness of the items to be washed. The dishwasher 1 then also serves as a storage and drying cabinet from which the items to be washed can be removed fresh and dry.

In particular for the "storage function", the conveying member can be activated, in particular, in a clocked manner. Alternatively, and particularly effectively, the conveying member is controlled via a moisture sensor system which provides a measurement of the current moisture level of the items to be washed located in the dishwasher cavity.

In both cases the conveying member is only switched on now and again in order to convey humid air repeatedly out of the dishwasher cavity 2 and thus to preserve the quality of the cleaning of the items to be washed, even over a lengthy time period. Due to the short effective running times, the energy consumption is low—as is the noise emitted by the at least one fan wheel or similar conveying member.

If required, however, it can also be advantageous if the conveying member is operated continuously with air to be blown out, in particular dishwasher-interior air, during the drying phase of the respective dishwashing program and/or during the entire time period of a potentially chronologically following "storage function phase" and/or another operating phase of the household dishwasher.

The invention claimed is:

1. A dishwasher, comprising:

a dishwasher cavity for treatment of items to be washed;

a door defining a front face of the dishwasher;

a panel that is positioned between the door and a floor in an installed position of the dishwasher and that is recessed relative to the door; and an air outlet for blowing out air from the dishwasher cavity, said air outlet arranged in a lower quarter of a height of the dishwasher and extending as a slotted outlet across at least two thirds of a width of the dishwasher, said air outlet including a first air-guiding element that defines an upper edge of the air outlet and that slopes downward at an angle between about 2 degrees toward the front face and about 10 degrees toward the front face to facilitate a targeted removal of air into a region in front of the front face of the dishwasher, and said air outlet extending over a top edge of the panel such that the air outlet protrudes toward the front face of the dishwasher a distance past the panel, the distance past the panel being less than a distance between a front side of the panel and the front face of the dishwasher.

2. The dishwasher of claim 1, constructed in a form of a household dishwasher.

3. The dishwasher of claim 1, wherein the first air-guiding element is formed by a wall which defines a top portion of the air outlet.

4. The dishwasher of claim 1, wherein the front face of the dishwasher faces a user.

5. The dishwasher of claim 3, wherein the air outlet includes a second wall which defines a bottom portion of the air outlet and forms a second air-guiding element, wherein the first air-guiding element and the second air-guiding element form a blow-out channel of several centimeters in length that protrudes toward the front face of the dishwasher the distance past the panel.

6. The dishwasher of claim 5, wherein the blow-out channel is defined as a whole by a plastics molded part.

7. The dishwasher of claim 5, wherein the blow-out channel includes a plurality of guide ribs extending in a direction of flow toward the front face for the outflowing air.

8. The dishwasher of claim 1, further comprising a channel extending on a rear face of the air outlet over a width of the air outlet and designed to be upwardly open for guiding sub-flows of air, wherein a front edge of the channel adjoins the air outlet at an angle, with the air outlet extending substantially horizontally.

9. The dishwasher of claim 8, further comprising an air distributor designed to introduce the air into the channel on the rear face, wherein the sub-flows are separated from a common airflow coming from the dishwasher cavity in the air distributor.

10. The dishwasher of claim 1, wherein the air outlet is at least 40 centimeters wide overall.

11. The dishwasher of claim 1, wherein the air outlet is configured as a flat slotted outlet with a height-to-width ratio of less than 1:20.

12. The dishwasher of claim 1, wherein the air outlet is configured as a flat slotted outlet with a height-to-width ratio of between 1:20 and 1:200.

13. The dishwasher of claim 1, wherein the air outlet is configured as a flat slotted outlet with a height-to-width ratio of approximately 1:100.

14. The dishwasher of claim 1, further comprising a plinth, wherein the panel terminates the plinth to a front of the dishwasher.

15. The dishwasher of claim 8, further comprising;

an air supply line designed with an excess length and supplying humid air from the dishwasher cavity to the channel; and wherein after dismantling the panel, the air outlet together with the channel is moveable away from the panel while the air supply line remains in a mounted position.

* * * * *